US006913405B2

(12) United States Patent
Fischer et al.

(10) Patent No.: US 6,913,405 B2
(45) Date of Patent: Jul. 5, 2005

(54) SUBSTANCE APPLICATOR

(75) Inventors: Jeffrey Fischer, Warminister, PA (US); Mary Ann Alexander, Holland, PA (US)

(73) Assignee: Clarence J. Venne, L.L.C., Levittown, PA (US)

( * ) Notice: Subject to any disclaimer, the term of this patent is extended or adjusted under 35 U.S.C. 154(b) by 27 days.

(21) Appl. No.: 10/637,029

(22) Filed: Aug. 7, 2003

(65) Prior Publication Data

US 2005/0031398 A1 Feb. 10, 2005

(51) Int. Cl.[7] ..... A46B 5/02; B43M 11/06; B05C 21/00; B65D 6/08

(52) U.S. Cl. ..... 401/6; 401/183; 401/196; 220/669

(58) Field of Search ..... 401/6, 183, 184, 401/185, 186, 205, 206, 196; 220/660, 669, 675; D9/338, 542, 543, 551, 552, 558

(56) References Cited

U.S. PATENT DOCUMENTS

| | | | | |
|---|---|---|---|---|
| D138,621 | S | | 6/1944 | White |
| D190,889 | S | | 7/1961 | Koenigsberg |
| 3,436,163 | A | | 4/1969 | Calabrese et al. |
| D220,248 | S | | 3/1971 | Blumenthal |
| D222,336 | S | | 10/1971 | Leary |
| D223,438 | S | | 4/1972 | Parera |
| D247,697 | S | | 4/1978 | Bottcher |
| 4,795,156 | A | | 1/1989 | Paulish |
| D300,118 | S | | 3/1989 | Venne et al. |
| 4,863,171 | A | | 9/1989 | Rocheleau |
| 4,869,611 | A | | 9/1989 | Noll |
| D303,926 | S | | 10/1989 | Venne et al. |
| D310,249 | S | | 8/1990 | LaLonde |
| D326,118 | S | | 5/1992 | Black |
| 5,117,993 | A | | 6/1992 | Vesborg |
| D332,050 | S | | 12/1992 | Schmidt |
| D334,399 | S | * | 3/1993 | Ziegler ..... D19/42 |
| 5,222,823 | A | | 6/1993 | Conforti |
| D345,376 | S | | 3/1994 | Underwood, Jr. |
| 5,419,592 | A | | 5/1995 | Stuart |
| D367,293 | S | | 2/1996 | Williams |

(Continued)

*Primary Examiner*—David J. Walczak
(74) *Attorney, Agent, or Firm*—Caesar, Rivise, Bernstein, Cohen & Pokotilow, Ltd.

(57) ABSTRACT

An applicator includes a hollow body having a central longitudinal axis to hold a colored ink, a shoulder portion, a central recessed portion, and a base portion. The shoulder portion is located above and merging with the central recessed portion at an upper end thereof and includes a top wall having an opening. The base portion is located below and merges with the central recessed portion at a lower end thereof and includes a bottom wall. The central recessed portion has a smooth continuous sidewall formed as an oval with major and minor diameters. The central recessed portion merges with the sidewall portion of the shoulder portion at major upper flared surfaces and at minor upper flared surfaces. The major axis decreases uniformly toward the center. The minor axis has a substantially constant dimension.

29 Claims, 6 Drawing Sheets

U.S. PATENT DOCUMENTS

| | | | | | |
|---|---|---|---|---|---|
| D367,943 | S | | 3/1996 | Tien | |
| D381,042 | S | | 7/1997 | Roche | |
| D389,365 | S | | 1/1998 | Lipson | |
| D389,865 | S | * | 1/1998 | Venne et al. | D19/48 |
| 5,713,681 | A | * | 2/1998 | Venne et al. | 401/202 |
| D396,244 | S | | 7/1998 | Venne et al. | |
| D401,270 | S | | 11/1998 | Cockram | |
| D403,347 | S | | 12/1998 | Cockram | |
| 5,927,880 | A | | 7/1999 | Allison et al. | |
| D414,702 | S | | 10/1999 | Bodker et al. | |
| D416,199 | S | | 11/1999 | Alguire et al. | |
| D427,914 | S | * | 7/2000 | Croft et al. | D9/542 |
| 6,095,705 | A | * | 8/2000 | Phillips | 401/6 |
| D432,572 | S | | 10/2000 | Aponte-Oerning | |
| D443,641 | S | | 6/2001 | Mader | |
| D445,831 | S | | 7/2001 | Lindner | |
| D448,408 | S | * | 9/2001 | Calabro et al. | D19/48 |
| 6,294,021 | B1 | | 9/2001 | Platzcke et al. | |
| D451,025 | S | | 11/2001 | Meeker et al. | |
| D455,782 | S | | 4/2002 | Singh et al. | |
| D459,755 | S | | 7/2002 | Calabro et al. | |
| D461,502 | S | | 8/2002 | Horie | |

* cited by examiner

SUBSTANCE APPLICATOR

BACKGROUND OF THE INVENTION

1. Field of the Invention

This invention relates generally to substance applicators or markers and particularly to substance applicators for surfaces or items requiring the application of a mark or coating thereon by persons, wherein the substance applicator is gripped and inverted by the person and force is applied to the surface or item by way of the gripped and inverted substance applicator to apply the mark to the surface. Various applicators for use by persons to mark surfaces in this manner are commercially available. Some particularly effective prior art applicators are sold by the assignee of the subject invention, Clarence J. Venne, Inc. of Levittown, Pa., under the trademark DAB-O-INK, and are shown in the following U.S. Design Pat. Nos. D274,697, D300,118, D303,926, D396,244, D389,365 and D138,621.

While many prior art substance applicators including those of the assignee of this invention, were suitable for their intended purposes, such applicators could nevertheless leave things to be desired from one or more standpoints. For example, the prior art applicators could leave things to be desired with respect to the economics of manufacturing and, importantly, with respect to ergonomics.

In particular, the prior art is not completely satisfactory with respect to providing ease of gripping for a person who wishes to comfortably and ergonomically grip an applicator disposed in any one of a number of differing rotational positions. This is useful, for example, when the normal use of the applicator includes repeatedly disposing the applicator upon a surface, either upright or laying down on its side, and picking it up again at a later time, possibly in a different rotational position than the one in which it was originally released from the hand of the person.

However, when using the prior art applicators, it was often difficult for the person to merely pick the applicator up from a surface and grip it in whichever rotational position it may have presented itself on the surface and have his/her fingers rest against the surfaces of the applicator with which they were in contact in a manner that prevented his/her fingers and hand from becoming tired while using the applicator (for example, because of an awkward shape of the applicator).

Furthermore, it is desirable that such a grip of a applicator be comfortable both when the applicator is poised and awaiting use as an applicator, and when it is used repeatedly to apply force to a card or item to be marked. The grip is important because the applicators may be gripped tightly for long periods of time and may be forcibly applied to the card or item many times.

However, the prior art applicators have not been ergonomically designed and therefore can be awkward to hold while poised and/or while applying ink, thereby making it a tiring or even unpleasant experience to hold and use them for long periods of time. Thus, a properly designed applicator should fit the hand of the user, as well as provide resting locations for the fingers of the user while the user is gripping it, regardless of how it is griped and whether it is merely poised waiting to be used or actually being used to apply ink.

All references cited herein are incorporated herein by reference in their entireties.

2. Description of Related Art

BRIEF SUMMARY OF THE INVENTION

The applicator of the present invention is composed of a plastic material which is molded (e.g., injection blow-molded or extrusion blow molded) to form a hollow body having a central longitudinal axis extending vertically therethrough when the applicator is in its upright standing position, and a cap for being releasable secured to the applicator. The hollow body of the applicator is arranged to hold a substance for applying the substance to a surface. The applicator can be any bottle or container suitable for containing the substance to be applied.

The applicator of the present invention includes a shoulder portion, a pinched central recessed portion and a base portion. The shoulder portion of the applicator is located above the central recessed portion and includes a top wall having an opening therein. The base portion is located below the central recessed portion and includes a bottom wall. The shoulder portion includes a sidewall portion of circular periphery having a predetermined outside diameter measured perpendicular to the central longitudinal axis of the applicator.

The base portion includes a sidewall portion of circular periphery having the same predetermined outside diameter measured perpendicular to the same axis as the shoulder portion. The central recessed portion includes a pinched oval side wall having a major axis and a minor axis. The major axis measured perpendicular to the central longitudinal access decreases in size from the top of the central recessed portion toward the middle of the central recessed portion and from the bottom of the central recessed portion toward the middle thereof to provide the pinched feature of the applicator. The minor axis measured perpendicular to the central longitudinal axis is a lesser dimension than the major axis that is substantially constant.

The central region of the applicator merges with the side wall portion of the shoulder at two major upper flared surfaces that extend parallel to the major axis. The major upper flared surfaces are arranged to receive the thumb of one hand of a person holding the applicator when the applicator is rotated into either of two diametrically opposing rotational positions and disposed in the crook between the thumb and the index finger. The major upper flared surface opposing the upper-flared surface receiving the thumb is arranged to permit it to receive at least part of the middle finger of the hand if the person's grip on the applicator disposes the middle finger against it.

The central region portion of the applicator also merges with the side wall of the shoulder at two minor flared surfaces that extend parallel to the minor axis. The minor upper flared surfaces are arranged so that one of them can receive the tip of the index finger of the person holding the applicator when the applicator is gripped in one of the foregoing two diametrically opposing rotational positions. Alternately, the person may choose to dispose his/her thumb and middle finger on the minor upper flared surfaces, depending on the rotational position of the applicator when it is picked up, and depending on whether the person wants to rotate it into a different rotational position after picking it up. If the person wants to grip the applicator in this manner, the top of the person's index finger can be rested against either one of the major upper flared surfaces.

Therefore, the invention is an applicator formed of a moldable plastic material and including a hollow body having a central longitudinal axis, the hollow body being arranged to hold a substance therein for marking a surface, the body including a shoulder portion, a central recessed portion, and a base portion, the shoulder portion being located above the central recessed portion and merging with the central recessed portion at an upper end thereof and including a top wall having an opening therein, the base portion being located below the central recessed portion and merging with the central recessed portion at a lower end thereof and including a bottom wall, the shoulder portion including a sidewall portion of circular periphery having a first predetermined outside diameter measured perpendicular to the central longitudinal axis, the base portion including a sidewall portion of circular periphery having the first predetermined outside diameter measured perpendicular to the central longitudinal axis, the central recessed portion including a smooth continuous sidewall formed as an oval having a major outside diameter and a minor outside diameter, the major outside diameter, central recessed portion of the body merging with the sidewall portion of the shoulder portion at major upper flared surfaces and at minor upper flared surfaces, having a dimension that decreases uniformly in the downward direction from the upper end of the central recessed portion and decreasing in the upward direction from the lower end of the central recessed portion to a minimum dimension substantially at the middle of the central recessed portion, the minor outside diameter having a dimension that is substantially constant from the bottom of the minor upper flared regions downward to the vicinity of the base portion, the major upper flared surfaces being shaped to receive the thumb and middle finger of one hand of a person and the minor upper flared surfaces being shaped to receive the index finger of the hand of the person to enable the person to matingly hold the applicator in diametrically opposed rotational positions and is positioned to apply axial force to the applicator to be readily inverted to orient the applicator downward and to permit force readily to te applied to the surface by way of the applicator.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following example, but it should be understood that the present invention is not deemed to be limited thereto.

Figure 1:
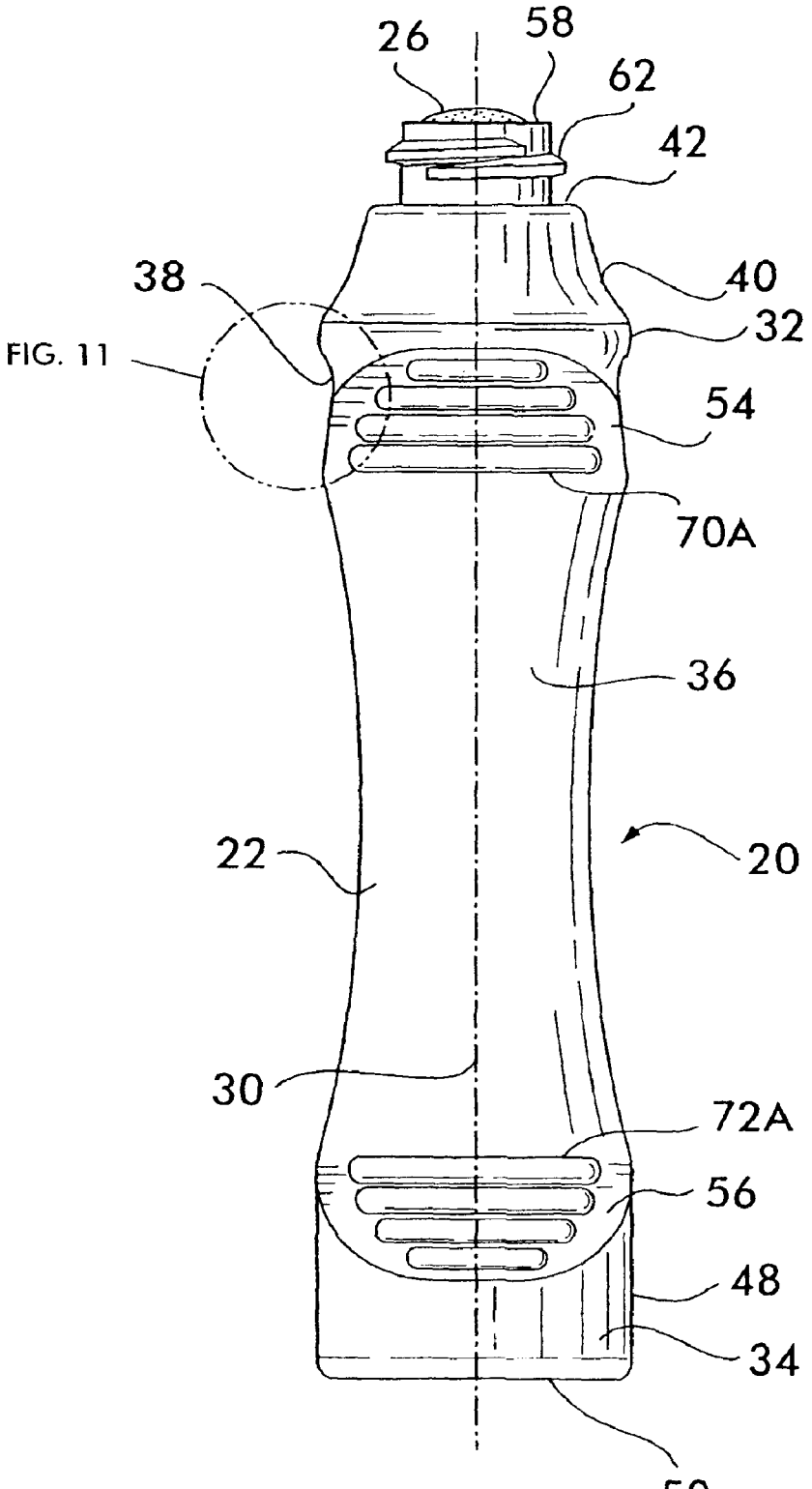
FIG. 1 is a front view of the applicator of the present invention.
Figure 2:
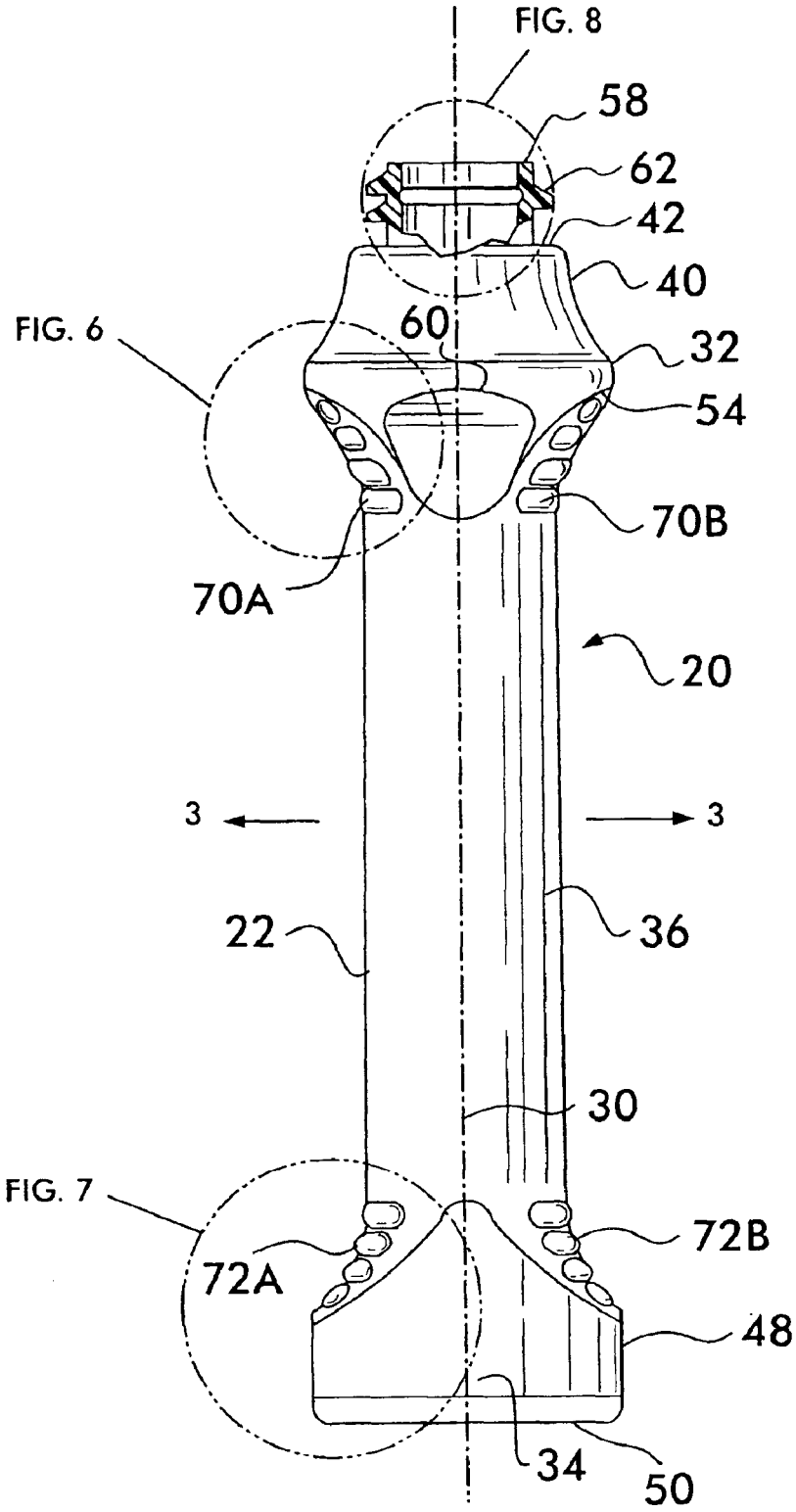
FIG. 2 is a side view of the applicator of FIG. 1.

Referring now to various figures of the drawings where like reference numerals refer to like parts, there is shown at 20 in FIGS. 1 and 2 a substance applicator constructed in accordance with the subject invention. The substance applicator 20 can be a bottle or other container adapted to contain a substance in the interior thereof for the application of the substance to a surface under the control of a user. The substance contained within the substance applicator 20 for application to the surface can be an ink, for example, for applying the ink to a surface such as the surface of a bingo card or other type of game card. Additionally, the substance contained within the substance applicator 20 can be a shampoo, a dye, a conditioner or any other hair products, or substances for use in arts and crafts, such as glue. The substance contained within the applicator 20 can also be a paint or inking substance such as window paint, poster paint, bathtub paint, blackboard paint or various types of childrens' paints, varnishes and other coatings. Furthermore, materials for use in an office environment, shoe polish, soap, cosmetics, nail polish, sealing agents, medicaments, or any substance suitable for applying the substance to a surface as described herein can be applied to a surface using the substance applicator 20.

The substance applicator 20 basically comprises a hollow body 22 having an opening 58 at the top thereof and threads 62 for receiving and securing a cap (not shown) and an applicator substance transferring device 26. The cap for the substance applicator 20 can be of any suitable shape in the interest of aesthetics, providing it includes interior threads for mating with the threads 62 of the applicator 20.

The structural details of the body 22 will be described later. Suffice it to state that the body 22 of the substance applicator 20 includes a large hollow interior space or cavity for receipt of the substance therein as previously described. The substance transferring device 26 of any conventional type that is used for the particular substance disposed within the applicator 20. The substance transferring device 26 inserted into the opening 58 at the top of the applicator 20. Preferably the substance transferring device 26 inserted therein constitutes a spring valve device or other easy-flow device, such as included in the aforementioned DAB-O-INK bingo markers of Applicants' Assignee if the substance is an ink.

The substance within the interior of the applicator 20 is placed in communication with the substance transferring device 26 when the applicator 20 is inverted, so that when the applicator 20 with the cap removed is inverted and brought into forcible engagement with a surface (not shown) or other item to be marked, the substance transferring device 26 applies a mark to the surface or item. The mark can be circular or any other shape, depending on the substance within the applicator 20 and the shape of the substance transferring device 26. For example, relatively smaller markings may be applied if the substance is eye makeup or another cosmetic. The substance applicator 20 is arranged to be held in the crook formed between the thumb and index finger of a hand, with the thumb, index finger and middle finger of the hand resting on portions of the applicator 20, so that the applicator 20 can be inverted and manipulated like a pencil, pen, or other writing instrument.

When the applicator 20 is no longer needed to mark a surface, the cap is threadibly received by the threads 62, thereby sealing off the substance transferring device 26 from the ambient air, and preventing the substance from drying out and/or allowing the substance in the cavity of the body 22 to leak, harden or evaporate.

The body 22 of the substance applicator 20 is formed of an suitable plastic material, which is preferably blow molded by extrusion or injection, so that it is a unitary member of substantially uniform wall thickness. As can be seen clearly in FIGS. 1 and 2 the body 22 of the substance applicator 20 is an elongated member having a central longitudinal axis 30 extending therethrough. The body 22 includes a shoulder portion 32, a base portion 34 and a central recessed portion 36.

The shoulder portion 32 includes a cylindrically circular sidewall 38 extending around the central longitudinal axis 30, and having a predetermined exterior diameter (e.g., approximately 1.665 inch (42.29 mm), measured perpendicular to the central axis 30, a slightly concave conical intermediate sidewall 40 extending up from the circular sidewall 38, and a generally planar top wall 42 in one preferred embodiment adapted to contain approximately four ounces of substance. It will be understood that the applicator 20 can be adapted to contain other amounts of substance and that the dimensions of the applicator 20 can be adjusted accordingly, as shown in more detail below, without departing from the spirit and scope of the invention. The top wall 42 of the applicator 20 includes an open circular neck centered about the central longitudinal axis 30. The helical thread 62 extends about the open circular neck. The substance transfer device 26 can be mounted on the top of the neck centered around the central longitudinal axis 30 in a conventional manner.

The base portion 34 of the applicator 20 includes a cylindrically circular sidewall 48 extending around the axis 30 and having substantially the same predetermined exterior diameter as the shoulder portion 32 measured perpendicular to the central axis 30. The base portion 34 of the applicator 20 also includes a generally planar bottom wall 50. The applicator 20 can be stored by disposing it on a support surface (not shown) with its planar bottom wall 50 in engagement therewith.

As will be appreciated by those skilled in the art, the fact that the shoulder portion 32 and the base portion 34 each include a circular sidewall 48 of the same outside diameter centered about the central longitudinal axis 30 enables the applicator 20 to be readily molded and removed from the molding machine. Moreover, the substance applicator 20 can be readily filled with substance during manufacturing regardless of its orientation within a filling machine.

The intermediate portion 36 or central recessed portion 36 of the applicator 20 is constructed and sized and provided with a pinched in shape to permit it to be ergonomically held within the crook between the thumb and index finger of one hand of the person holding the applicator 20 when the applicator 20 is either poised for use or inverted and put into use by applying it to a surface. For example, the applicator 20 can be held like a pencil or pen in a plurality of different rotational positions to mark the surface of a bingo card or other item. To that end the central recessed portion 36 is provided in the form of a substantially oval sidewall. The oval sidewall has major outside diameter, or axis, D1 that is measured perpendicular to the central longitudinal axis 30. The oval sidewall also has a minor outside diameter, or axis, D2 that is measured perpendicular to the central longitudinal axis 30. The minor axis D1 is perpendicular to the major axis D2

Figure 3:
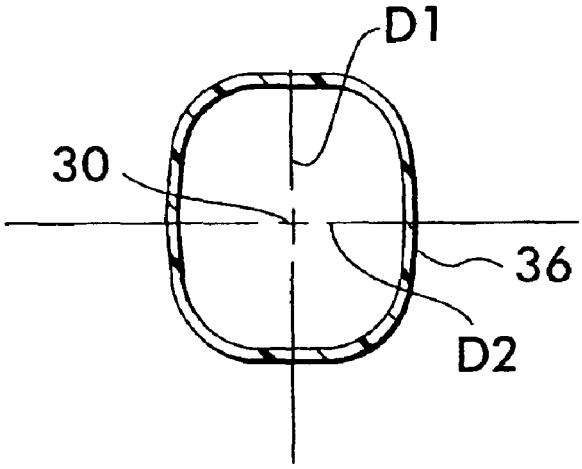
FIG. 3 is a cross-sectional view of the applicator of FIG. 2 approximately at the middle of the central recessed region thereof.
Figure 4:
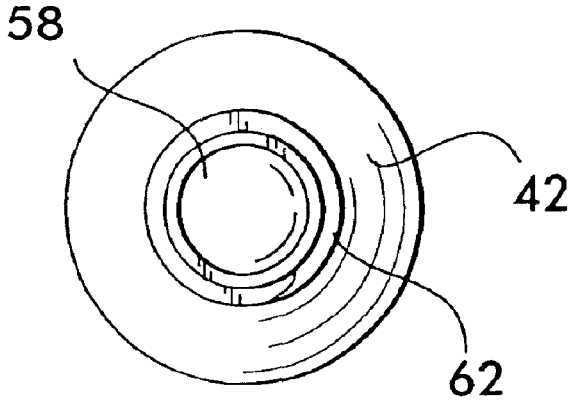
FIG. 4 is a top view of the applicator of FIG. 1.
Figure 5:
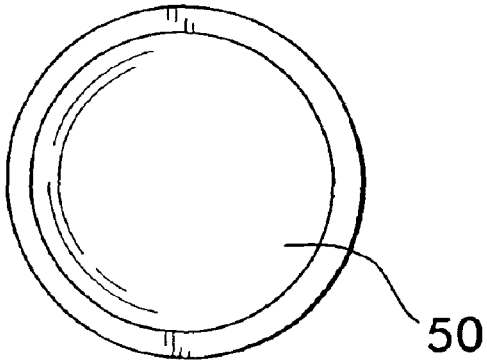
FIG. 5 is a bottom view of the applicator of FIG. 1.
Figure 6:
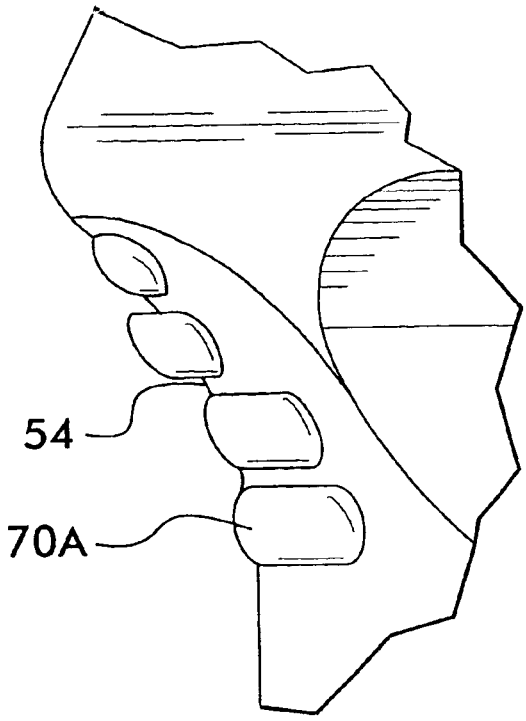
FIG. 6 is an expanded view of an upper flared portion of the applicator of FIG. 1.
Figure 7:
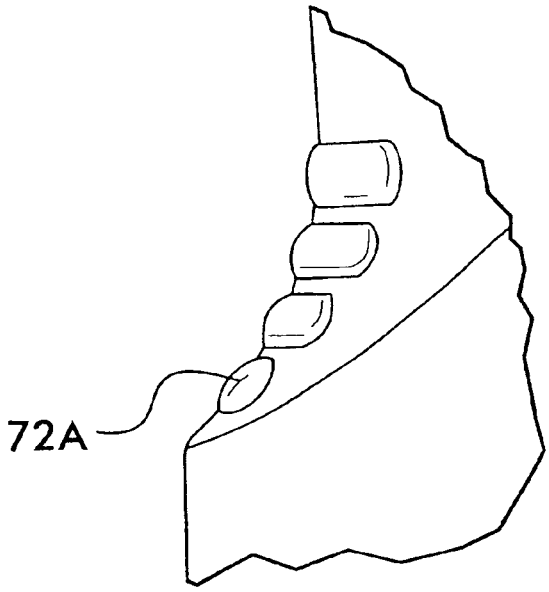
FIG. 7 is an expanded view of a lower flared portion of the applicator of FIG. 1.
Figure 8:
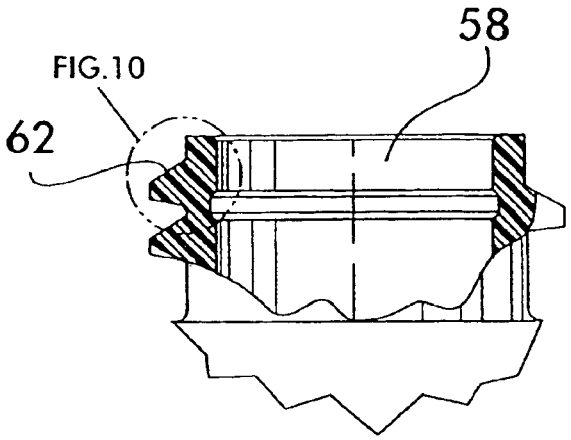
FIG. 8 is an expanded view of an upper portion of the applicator of FIG. 1.
Figure 10:
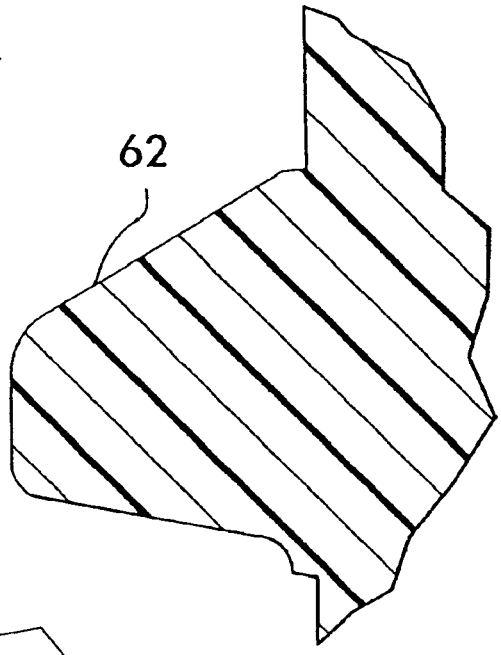
FIG. 10 is an expanded view of an upper portion of the applicator of FIG. 1.
Figure 11:
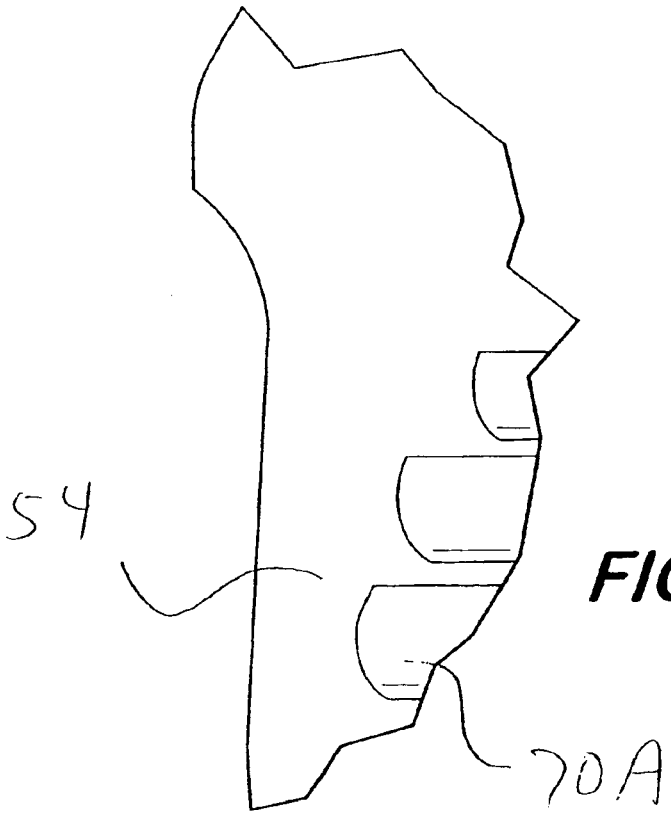
FIG. 11 is an expanded front view of an upper flared portion of the applicator of FIG. 1.
Figure 9:
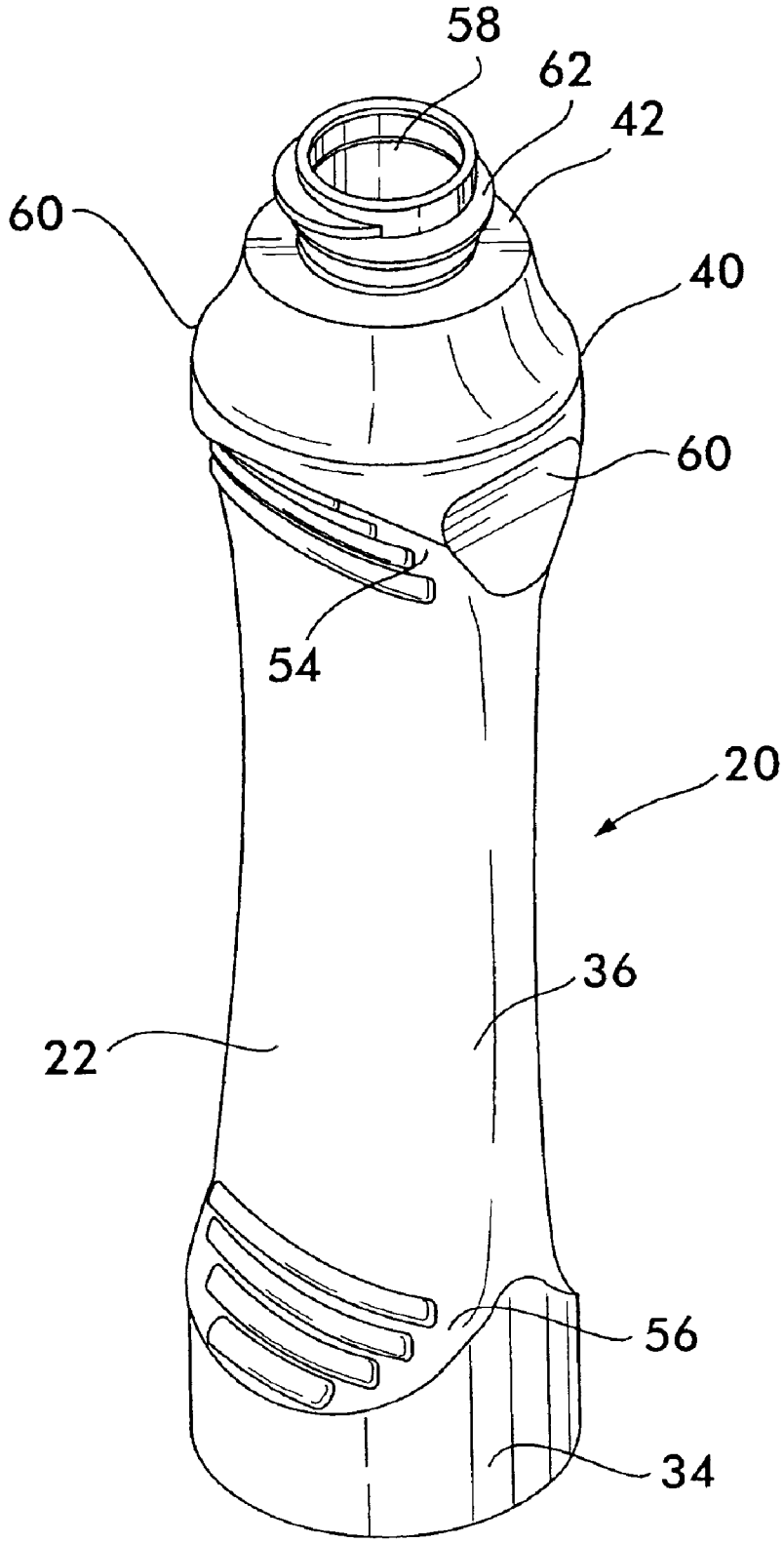
FIG. 9 is an isometric view of the applicator of FIG. 1.

In order to provide the pinched shape for assisting a person when gripping the body 22, the major outside axis or diameter D1 decreases to a minimum dimension in the middle of the central recessed portion 36, as most readily seen in FIGS. 1 and 3. In the upward direction from the middle of the central recessed portion 36, the dimension of the major axis D1 increases and, in the preferred embodiment, approaches the outside diameter of the sidewall 38 of the shoulder 32 in its upper region.

In the downward direction from the middle of the central recessed portion 36, the dimension of the major axis D1 of the preferred embodiment increases and approaches the diameter of the sidewall 48 of the base portion 34 in its lower region. The minimum dimension of the major axis D1 at the middle of the central recessed portion 36 can be 1.291 inches (32.79 mm) measured perpendicular to the central longitudinal axis 30, in the preferred embodiment of the invention adapted to contain approximately four ounces of substance.

In the same preferred embodiment, the minor outside axis diameter D2 is of a lesser dimension than the major outside diameter D1, approximately 1.030 inch (26.16 mm). This feature ensures that the central recessed portion 36 is sufficiently narrow to enable it to be easily held within the crook between the thumb and the index finger, with the middle finger preferably resting upon the central recessed portion 36. This also enables the substance holding capacity of the applicator 20 to be larger than if the central recessed portion 36 of the applicator 20 was of circular cylindrical shape having a single outside diameter equal to the minor outside diameter. The dimension of the minor axis D2 is substantially constant over the length of the center of the body 22.

The oval shape of the central recessed portion 36 can also be useful for providing two large viewing panels for one or more labels to be affixed thereto. In the preferred embodiment, the labels affixed to the applicator 20 can be conventional adhesive labels, shrink wrapped labels, or any other type of labels.

As best seen in FIGS. 1 and 2, the sidewalls of the central recessed portion 36 of the body 22 merge with the sidewall 38 of the shoulder portion 32 at two major upper flared surfaces 54 (parallel to the major axis D1) and two minor upper flared surfaces 60 (parallel to the minor axis D2). The upper flared surfaces 54, 60 of the applicator 20 are adapted to cooperate to permit convenient mating of the substance applicator 20 with the hand of a person and ergometric use of the applicator 20 when the applicator substance 20 is picked up in a plurality of different rotational positions and gripped, both while it is poised and ready for use, and when it is inverted to apply force to a surface to be marked.

Respective groups of ridges 70A and 70B can be provided on the two major upper flared surfaces 54 of the central recessed portion 36 of the applicator 20 immediately below the shoulder 32, i.e., the upper flared portion of the recess. In one embodiment of the invention, there can be four ridges in each of the ridge groups 70A and 70B. The ridges of each ridge group 70A and 70B can be of graduated lengths that decrease in the direction from the lowermost of the ridges to the uppermost as shown in FIG. 1.

Additionally, two ridge groups 72A and 72B of horizontally disposed ridges can be provided on the lower flared surface 56 in the central recessed portion 36 of the applicator 20 immediately above the base portion 34. Furthermore, in an alternate embodiment (not shown) ridges of graduated length can be provided on the minor upper flared surfaces 60. In alternate embodiments of the invention the major and minor upper flared surfaces 54, 60 can be formed as substantially smooth surfaces having no ridges.

The ridge groups 70A and 70B of the upper flared surfaces 54 and any ridges disposed on the minor upper flared surfaces 60 cooperate with the upper flared surfaces 54, 60 to facilitate the holding of the applicator 20 by providing a more secure grip when the applicator 20 is inverted and used to apply a mark to a surface. In particular, for some persons the ridges on the flared surfaces 54, 60 can serve as a deterrent to gripping the applicator 20 too close to the shoulder 32 when inverting it for use, which action could result in a "top-heavy" feeling, particularly when the applicator 20 is completely full of substance.

Thus, the inclusion of the ridges 70A and 70B on the flared portions of the central recess immediately below the shoulder can provide a finger grip to induce those persons to grip the central recessed portion of the applicator 20 further toward the center of the applicator 20 when the applicator 20 is very full. This avoids a "top heavy" feeling while permitting those persons to grip the applicator 20 on the ridges closer to the shoulder when the applicator 20 is less full (and hence less prone to produce a "top heavy" feeling).

The height of the applicator 20 can be any dimension desired depending on the amount of substance to be disposed therein. One particularly effective height to provide a capacity of approximately four ounces for ink or other substance is approximately 6.596 inches (167.5 mm) from the base wall 50 to the top of the opening the embodiment. It will be understood that substance applicators 20 adapted to contain other amounts of substance for application to a surface can have differing dimensions, as previously described, including differing heights, D1 and D2

Other sizes of the applicator 20 that are also contemplated within the scope of the invention but do not limit the scope of the invention are set forth below. For example, in one alternate embodiment of the invention, adapted to contain approximately three ounces of substance for application to a surface, the outside diameter of the cylindrically circular sidewall 38 of the shoulder portion 32 extending around the central axis 30 can be approximately 1.540 inches (39.12 mm), the major axis D1 can be 1.226 inches (31.14 mm), the minor axis diameter D2 can be approximately 1.030 inch (26.16 mm), and the height of the applicator 20 can be approximately 5.540 inches (140.17 mm). It will be understood that applicators 20 containing substantially more than four ounces of substance and substantially less than fifty milliliters of substance can be provided.

In an additional alternate embodiment, adapted to contain approximately fifty milliliters of substance for application to a surface, the outside diameter of cylindrically circular sidewall 38 can be approximately 1.285 inches (32.64 mm) and the major axis D1 can be 1.124 inches (28.55 mm). The minor outside axis diameter D2 of the substance applicator 20 can be approximately 0.750 inch (1.905 mm) and the height of the substance applicator 20 can be approximately 4.789 inches (121.5 mm). It will be understood that applicators 20 containing substantially more than four ounces of substance and substantially less than fifty milliliters of substance can be provided.

While the invention has been described in detail and with reference to specific examples thereof, it will be apparent to one skilled in the art that various changes and modifications can be made therein without departing from the spirit and scope thereof.

What is claimed is:

1. An applicator, said applicator being formed of a moldable plastic material and comprising a hollow body having a central longitudinal axis, said hollow body being arranged to hold a substance therein, said body including a shoulder portion, a central-recessed portion, and a base portion, said shoulder portion being located above said central recessed portion and merging with said central recessed portion at an upper end thereof and including a top wall having an opening therein, said base portion being located below said central recessed portion and merging with said central recessed portion at a lower end thereof and including a bottom wall, said shoulder portion including a sidewall portion of circular periphery having a first predetermined outside diameter measured perpendicular to said central longitudinal axis, said base portion including a sidewall portion of circular periphery having said first predetermined outside diameter measured perpendicular to said central longitudinal axis, said central recessed portion including a smooth continuous sidewall formed as an oval having a major outside diameter and a minor outside diameter, said central recessed portion of said body merging with said sidewall portion of said shoulder portion at major upper flared surfaces and at minor upper flared surfaces, said major outside diameter having a dimension that decreases uniformly in the downward direction from said upper end of said central recessed portion and decreases uniformly in the upward direction from said lower end of said central recessed portion to a minimum dimension substantially at the middle of said central recessed portion, said minor outside diameter having a dimension that is substantially constant from the bottom of said minor upper flared regions downward to the vicinity of said base portion, said major upper flared surfaces being shaped to receive the thumb and middle finger of one hand of a person and said minor upper flared surfaces being shaped to receive the index finger of said hand of said person to enable said person to matingly hold said applicator in diametrically opposed rotational positions and is positioned to apply axial force to said applicator to be readily inverted to orient said applicator downward and to permit force readily to be applied to said surface by way of said applicator.

2. The applicator of claim 1 adapted to receive the index finger of said hand of said person to permit said person to hold said applicator wherein said minimum dimension of said major outside diameter is approximately 1.291 inches (32.79 mm) measured perpendicular to said central longitudinal axis.

3. The applicator of claim 2 wherein said minor outside diameter is approximately 1.030 inches (26.16 mm) measured perpendicular to said central longitudinal axis.

4. The applicator of claim 3 wherein said applicator has a height of approximately 6.596 inches (167.5 mm).

5. The applicator of claim 1 adapted to receive the index finger of said hand of said person to permit said person to hold said applicator wherein said minimum dimension of said major outside diameter is approximately 1.226 inches (31.14 mm) measured perpendicular to said central longitudinal axis.

6. The applicator of claim 5 wherein said upper flared surfaces have concave arcuate surfaces for receiving the thumb and the index finger of said person.

7. The applicator of claim 5 wherein said minor outside diameter is approximately 1.030 inches (26.16 mm) measured perpendicular to said central longitudinal axis.

8. The applicator of claim 7 wherein said applicator has a height of approximately 5.540 inches (140.7mm).

9. The applicator of claim 1 adapted to receive the index finger of said hand of said person to permit said person to hold said applicator wherein said minimum dimension of said major outside diameter is approximately 1.124 inches (28.55 mm) measured perpendicular to said central longitudinal axis.

10. The applicator of claim 9 wherein said outside minor outside diameter is approximately 0.075 inches (1.905 mm) measured perpendicular to said central longitudinal axis.

11. The applicator of claim 10 wherein said applicator has a height of approximately 4.789 inches (121.6.mm).

12. The applicator of claim 1 wherein, said major upper flared surfaces are substantial smooth.

13. The applicator of claim 1 additionally comprising a first ridge disposed upon a first one of said major upper flared surfaces.

14. The applicator of claim 13 additionally comprising a second ridge disposed upon a second major upper flared surface of sail major upper flared surfaces.

15. The applicator of claim 14 additionally comprising respective pluralities of ridges disposed upon each of said first and second major upper flared surfaces.

16. The applicator of claim 1 wherein said minor upper flared surfaces are formed as substantially smooth surfaces.

17. The applicator of claim 16 additionally comprising a third ridge disposed upon a first minor flared surface.

18. The applicator of claim 17 additionally comprising a fourth ridge disposed upon a second minor flared surface.

19. The applicator of claim 18 additionally comprising respective pluralities of ridges disposed upon each of said first and second minor flared surfaces.

20. The applicator of claim 1 additionally comprising respective pluralities of ridges disposed upon each of said major and minor upper flared surfaces.

21. The applicator of claim 20 wherein said ridges of said respective pluralities of ridges extend across said major and minor flared surfaces generally perpendicular to said central longitudinal axis.

22. The applicator of claim 20, wherein said ridges of said respective pluralities of ridges have graduated lengths.

23. The applicator of claim 1 wherein said shoulder portion also includes a conical surface terminating in said top wall, said top wall having a circular periphery centered about said central longitudinal axis.

24. The applicator of claim 1, wherein said substance within said body comprises ink.

25. The applicator of claim 1, wherein said substance within said body comprises a hair product.

26. The applicator of claim 1, wherein said substance within said body comprises a paint.

27. The applicator of claim 1, wherein said substance within said body comprises a soap.

28. The applicator of claim 1, wherein said substance within said body comprises a coating.

29. The applicator of claim 1, wherein said substance within said body comprises a cosmetic product.

* * * * *